US006076827A

United States Patent [19]

Luchsinger

[11] Patent Number: 6,076,827

[45] Date of Patent: Jun. 20, 2000

[54] MAGNETIC SHOOTER WITH FLEXIBLE/ SWIVELING SHAFT

[76] Inventor: Charles Luchsinger, 14 Briarwood Dr., Glen Cove, N.Y. 11542

[21] Appl. No.: 09/241,755

[22] Filed: Feb. 1, 1999

[51] Int. Cl.[7] ..... A63B 71/04

[52] U.S. Cl. ..... 273/129 R; 273/126 A; 273/129 L

[58] Field of Search ..... 273/129 R, 129 L, 273/129 V, 129 W, 126 R, 126 A, 118 R, 119 R, 119 A

[56] References Cited

U.S. PATENT DOCUMENTS

| | | | |
|---|---|---|---|
| 825,890 | 7/1906 | Bristow | 273/129 R |
| 1,648,956 | 11/1927 | Meade . | |
| 3,090,622 | 5/1963 | Sire . | |
| 3,214,171 | 10/1965 | Luchsinger . | |
| 3,448,982 | 6/1969 | Griggs . | |
| 3,554,549 | 1/1971 | Grabowski . | |
| 4,331,334 | 5/1982 | Clemmer | 273/129 W X |
| 4,616,830 | 10/1986 | Moore | 273/126 R |
| 5,031,907 | 7/1991 | Warehime . | |
| 5,039,099 | 8/1991 | Bravo . | |
| 5,242,164 | 9/1993 | Nicoll | 273/108.5 X |

*Primary Examiner*—Raleigh W. Chiu
*Attorney, Agent, or Firm*—Collard & Roe, P.C.

[57] ABSTRACT

The invention relates to a magnetic shooter with a flexible shaft for propelling a magnetic game piece within a game board. The magnetic shooter contains a base piece, a magnetic piece attached to the base, and a flexible shaft connected to the base. The connection of the flexible swiveling shaft to the base piece can allow a 180 degree rotation of the flexible shaft about a horizontal axis. In addition, the base piece has at least one pointed end to allow a game player to point the shooter and aim the game pieces before striking them.

11 Claims, 3 Drawing Sheets

MAGNETIC SHOOTER WITH FLEXIBLE/ SWIVELING SHAFT

BACKGROUND OF THE INVENTION

1. Field of the Invention

The present invention relates to a magnetic shooter with a flexible/swiveling shaft for a game board. The magnetic shooter contacts other magnetic balls or pucks on the game board and propels them across the game board.

2. The Prior Art

Game shooters are known in the prior art. For example, U.S. Pat. No. 3,554,549 to Grabowski discloses a game having a magnetic scoring device for movement on the playing surface. The game pieces and the tips of the scoring object are both magnetic but have opposite polarity so that they will be attracted to each other. The magnetic tips and areas are bar magnets with north/south axes vertically disposed so that relative polarity is readily changed by flipping the pieces. These pieces are manipulated by individual stick members which are used to transport, impel or block and intercept an object.

U.S. Pat. No. 5,031,907 to Warehime discloses a magnetic marble stroking game and device. Magnetic marbles exert magnetic fields well beyond their physical bodies and are used to form game start patterns on a game board.

U.S. Pat. No. 5,039,099 to Bravo discloses a series of magnetic chips located on a game board. In this invention, the chips are propelled by a cue ball type chip that has the opposite magnetic polarity from the remaining chips.

U.S. Pat. No. 3,448,982 to Griggs discloses a magnetic deflection ball game. This design includes a non magnetic game board that has a lever attached thereto. In addition, attached to the lever is a spring to allow the lever to spring back under pressure.

U.S. Pat. No. 1,648,956 to Meade discloses an electric game that has a ball that can be controlled by electromagnets. The ball is formed with magnetic metal. Finally U.S. Pat. No. 3,090,622 to Sire discloses a magnetic game shooter for a magnetic game wherein the shooter has a retractable tip that then pushes forward to drive a magnetic ball.

Unlike the prior art, the present invention discloses a magnetic shooter with a flexible/swiveling shaft for snapping the shooter forward to propel a puck across a game board.

SUMMARY OF THE INVENTION

The invention relates to a device for sending a puck across a game board. In this case, the invention acts similar to a hockey stick that sends pucks or balls across a game board. The invention comprises a base plate that has a top face and a bottom face. In addition, the base plate is shaped so that it comes to a point at one end. This design is important because it serves to guide a person sending the puck. The base plate has at least three sides with a point at one end.

Attached to the bottom face of the base plate is a magnetic cylindrical disk. This magnetic cylindrical disk is used to contact a magnetic puck and send it across the game board beneath the cover. In this case, the game magnets are held captive below the game board in an enclosure with other non magnetic parts, chips, depressions or any other scoring means. Connected to the the base plate are two connecting arms. These connecting arms extend up from the base plate and have holes in their interior. These holes allow arm pieces to attach onto it so that the arm piece can swivel helping to propel the base plate and the cylindrical disk across a game board cover. The arm piece is essentially a flexible shaft that is made from a thin flexible material.

In using the magnetic shooter, the player drops it on the game cover directly above the game magnet on the floor of the game below. Both magnets are immediately attracted to each other through the cover and make a clicking sound. Next, the player aims the arrow head in the direction of the desired target and with a flick of the wrist, and a slightly forward motion, both magnets start toward the target. Most importantly, as the shooting magnet arcs upward at the end of its shot, it gradually releases its magnetic hold on the moving game magnet below the cover, allowing it to drop to the floor of the game and continue moving onto the target.

It is an object of the invention to provide a device for sending balls or pucks across a game board that has a swiveling flexible shaft.

Another object of the invention is to provide a device for sending balls or pucks across a game board that is simple in design and easy to manufacture.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
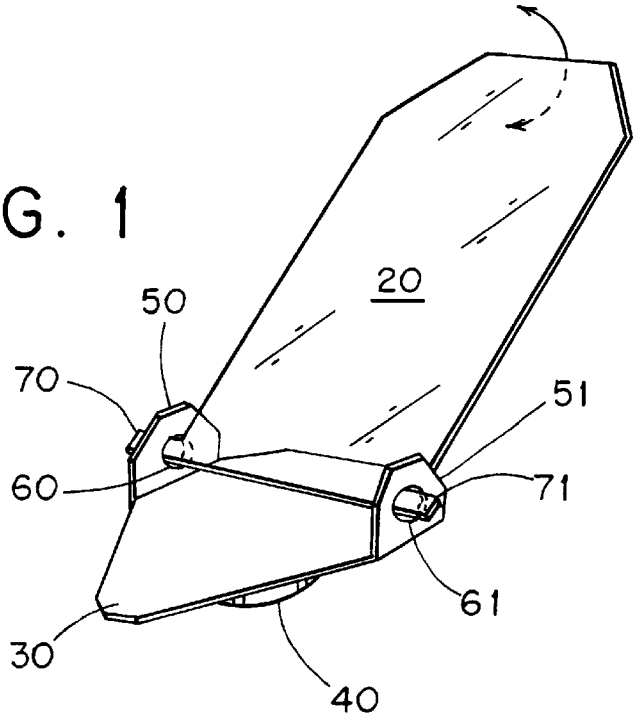
FIG. 1 is a perspective view of the magnetic shooter with a flexible shaft.
Figure 3:
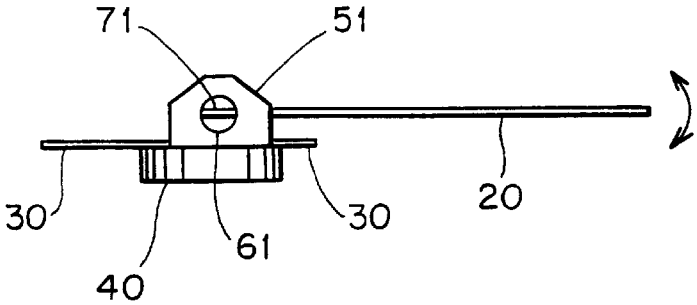
FIG. 3 is a side view of the magnetic shooter.
Figure 4:
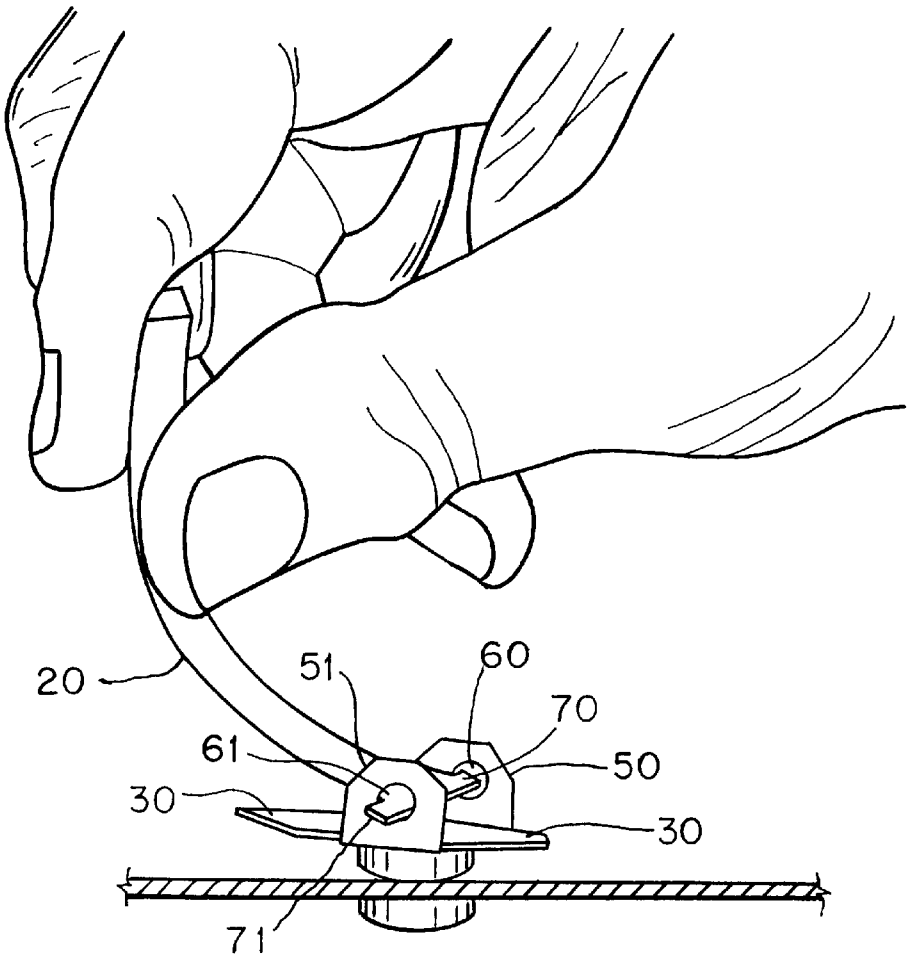
FIG. 4 is a side view of the magnetic shooter with the flexible shaft bent.

Referring to FIG. 1 there is shown a magnetic shooter 10 for sending magnetic puck 110 across game board 100 (FIG. 4). Device 10 has a flexible shaft 20 that serves as a shaft. Shaft 20 connects to a flat base plate 30 via connecting arms 50 and 51. Flat base plate 30 is made from a stiff plastic material wherein connecting arms 50 and 51 are molded right to base plate 30. Connecting arms 50 and 51 each have center holes 60 and 61 respectively. Center holes 60 and 61 are adapted to receive arm pieces 70 and 71 respectively on shaft 20. Shaft 20 can swivel within center holes 60 and 61 up to 180 degrees so that shaft 20 can lie parallel to base plate 30 (See FIG. 3) or substantially perpendicular to base plate 30 (See FIG. 5).

Figure 2:
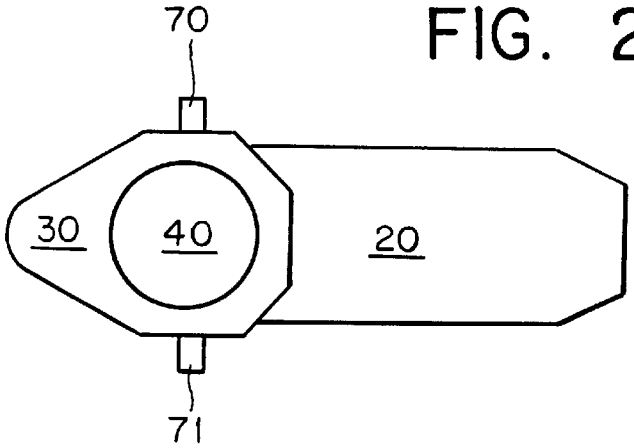
FIG. 2 is a bottom view of the magnetic shooter.

FIG. 2 shows a bottom view of device 10 showing the bottom end of shooting element or magnetic disk 40. Magnetic disk 40 attaches to base plate 30 wherein base plate 30 has at least one elongated end pointing forward to help a user guide a puck or a ball across a game board. This bottom view shows that arm pieces 70 and 71 stick out beyond connecting arms 50 and 51.

FIG. 3 shows a side view of device 10 which shows arm piece 71 as it fits through hole 61 on connecting arm 51. In this view, the thickness of disk 40 is shown relative to the thickness of plate 30. Disk 40 has substantial thickness to elevate plate 30 above a game board.

FIG. 4 shows device 10 in action so that shaft 20 is bent forward while base plate 30 remains in place. Base plate 30 and magnetic disk 40 remain in place because magnetic disk 40 presses against game board surface 100. Game board surface 100 can be a clear plastic surface with a top face 102 and a bottom face 104. Bottom face 104 faces game floor 120. In this case, magnetic disk 40 presses upon top face 102 and attracts magnetic puck 110 towards bottom face 104.

A user's thumb can be placed behind shaft 20 pushing the middle part forward while the index and middle finger can be used to hold the top of shaft 20 in place. In this position, shaft 20 builds in potential energy that is shown to be released in FIG. 5. To snap base plate 30 forward, the index finger pulls shaft 20 back while the thumb pushes shaft 20 forward. The release of this potential energy occurs with a snapping motion so that baseplate 30 and magnetic disc 40 snaps forward and upward.

Figure 5:
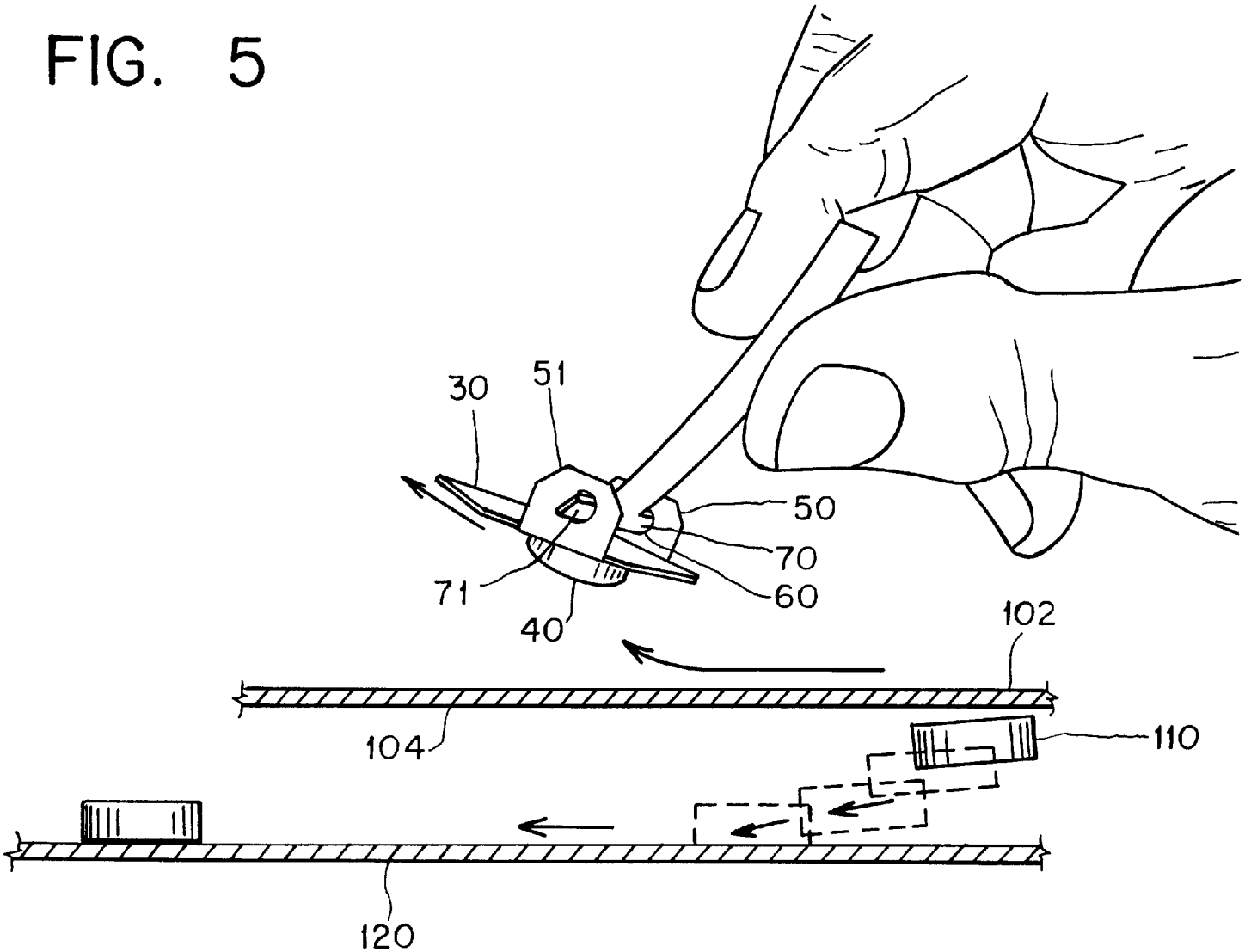
FIG. 5 is a side view of the magnetic shooter in its follow through motion.

As shown in FIG. 5, the magnetic disc 40 arcs upward at the end of the shot. With this motion, it gradually releases its magnetic hold on puck 110 allowing it to drop to floor 120 of the game and continue moving on towards the target. Because of this motion, puck 110 travels free from magnetic shooter 10 and across a game board below.

Accordingly, while one embodiment of the present invention has been shown and described, it is to be understood that many changes and modifications may be made thereunto without departing from the spirit and scope of the invention as defined in the appended claims.

What is claimed is:

1. A game shooter comprising:

a base;

a flexible shaft connected to said base; and a magnetic shooting element connected to said base wherein said magnetic shooting element is able to interact with a magnetic puck so that when said shaft is bent forward, and said base is released, said shaft snaps said magnetic shooting element forward to drive the magnetic puck across a game board.

2. The shooter as in claim 1, wherein the flexible shaft is elongated and shaped flat.

3. The shooter as in claim 1, wherein the flexible shaft is formed from flexible plastic.

4. The shooter as in claim 1, wherein said base comprises a substantially flat surface that narrows substantially to a point on at least one end.

5. The shooter as in claim 4, wherein said base surface has at least three sides.

6. The shooter as in claim 5, wherein said base is a seven sided surface.

7. The shooter as in claim 1, wherein said base further comprises connecting arms for receiving said flexible shaft.

8. The shooter as in claim 7, wherein said connecting arms each have center holes designed to receive said flexible shaft.

9. The shooter as in claim 8, wherein said flexible shaft has arm pieces designed to fit inside said center holes.

10. The shooter as in claim 7, wherein said flexible shaft can rotate around a horizontal axis within said connecting arms.

11. A magnetic game shooter comprising:

a base;

a flexible shaft connected to said base; and a magnetic shooting element connected to said base, wherein said magnetic shooting element is able to contact a magnetic puck through a game board cover so that when said shooting element is propelled forward, it drives the puck forward, below the cover and in its follow through, said shooting element raises above said game board cover allowing the puck to drop to a floor of the game board and be propelled forward, free from the shooting element.

* * * * *